US005634360A

United States Patent [19]

Tazoe et al.

[11] Patent Number: 5,634,360

[45] Date of Patent: Jun. 3, 1997

[54] GUIDING APPARATUS FOR ROUGHING MILL

[75] Inventors: Nobuhiro Tazoe, Yokohama; Hiroaki Kuwano, Yokosuka; Katsumi Okada, Fujisawa; Makoto Shitomi, Kurashiki; Hideyuki Nikaido, Chiba; Takeshi Fujitsu, Kurashiki; Katsumi Kawakami, Kurashiki; Tetsuo Shima, Kurashiki; Shinji Tanaka, Kurashiki, all of Japan

[73] Assignees: Ishikawajima-Harima Heavy Industries Co., Ltd., Tokyo; Kawasaki Steel Corportion, Hyogo-ken, both of Japan

[21] Appl. No.: 708,898

[22] Filed: Sep. 5, 1996

Related U.S. Application Data

[63] Continuation of Ser. No. 36,246, Mar. 24, 1993, abandoned.

[30] Foreign Application Priority Data

Sep. 21, 1992 [JP] Japan ..... 4-251628

[51] Int. Cl.[6] ..... B21B 39/14; B21B 37/00

[52] U.S. Cl. ..... 72/12.5; 72/250; 72/227

[58] Field of Search ..... 72/227, 235, 250, 72/251, 8.8, 11.5, 12.5

[56] References Cited

U.S. PATENT DOCUMENTS

| | | | |
|---|---|---|---|
| 2,072,121 | 3/1937 | Montgomery | 72/229 |
| 2,962,917 | 12/1960 | Drysdale | 72/250 |
| 3,104,566 | 9/1963 | Schurr et al. | 72/251 |

FOREIGN PATENT DOCUMENTS

| | | | |
|---|---|---|---|
| 0038716 | 2/1987 | Japan | 72/250 |
| 0056314 | 3/1988 | Japan | 72/250 |
| 0070302 | 3/1990 | Japan | 72/235 |
| 0013415 | 1/1992 | Japan | 72/250 |
| 0084616 | 3/1992 | Japan | 72/250 |
| 0158914 | 6/1992 | Japan | 72/250 |
| 2249508A | 5/1992 | United Kingdom . | |

*Primary Examiner*—Lowell A. Larson
*Assistant Examiner*—Thomas C. Schoeffler
*Attorney, Agent, or Firm*—Finnegan, Henderson, Farabow, Garrett & Dunner, L.L.P.

[57] ABSTRACT

A guiding method and apparatus are presented for preventing the generation of lateral curving in a rolled slab produced in a roughing mill train, consisting of an edging mill and a horizontal mill in tandem, for example. The apparatus basically includes a first side guide placed upstream at the entrance to the edging mill, a second side guide placed downstream at the exit of the horizontal mill and a third side guide placed between the edging mill and the horizontal mill. The first side guide at the entrance to the edging mill synchronously closes the separation distance of the guide components upon the entry of the rolled slab into the first side guide, leaving a narrow space between the guide and the rolled slab. The third side guide closes the separation spacing based on slab exit timing representing the instant the tail end of the rolled slab passes through the edging mill. The second side guide assumes a narrow separation distance when the head end of the rolled slab enters therebetween. The restraining force provided by the narrow separation distance prevents lateral shifting to occur during the rolling process thereby reducing snaking of the rolled slab.

15 Claims, 9 Drawing Sheets

GUIDING APPARATUS FOR ROUGHING MILL

This application is a continuation of application Ser. No. 08/036,246, filed Mar. 24, 1993, now abandoned.

BACKGROUND OF THE INVENTION

This application claims the priority of a Japanese Patent Application Number P4-251628 filed in Japan, on Sep. 21, 1992, which is incorporated herein by reference.

1. Field of the Invention

The present invention relates in general to a guiding apparatus for guiding a rolled slab in a continuous hot roughing mill train, and in particular to a guiding apparatus suitable for preventing lateral curving, or snaking, of the rolled slab produced in a roughing mill of a V-H tandem configuration comprising edger mills and horizontal mills.

2. Technical Background of the Invention

Hot strip roughing train in a continuous hot rolling operation generally comprises a plurality of V-H tandem mills including edger mills, to control the width dimension of a rolled slab, and horizontal rolls to control the thickness dimension of the rolled slab. The rolled slab moving from upstream to downstream in a rolling train is first rolled through the edging mill disposed on the upstream side, and then enters the horizontal mill positioned on the exit side, i.e. the downstream side, of the edging mill.

At the entrance to the edging mill (the upstream side), there are entry side guides provided to guide the rolled slab into the edging mill, but there are no side guides on the exit side of the horizontal mill.

The entry side guide of the edging mill waits for, or stands by, the arrival of the incoming rolled slab while setting the guide spacing at about 50–100 mm wider than the width of the rolled slab so as to accommodate the incoming rolled slab to eliminate possibilities of mechanical interference. When the rolled slab arrives within the side guides, it is centered in the edging mill and the rolled slab is rolled while being guided within the above mentioned spacing. This type of mill is termed a standby type.

An improved design of the entry side guides, based on hydraulic driven guides, was disclosed in a report (in Japanese) entitled, "Method of improving stability of strip rolling", in the 51st Meeting of the Iron and Steel Institute of Japan, Hot Strip Rolling Seminar 51-4 held on Nov. 16–17, 1989.

There is also a proposal to dispose a side guide facility between the edging mill and the horizontal mill as disclosed in a Japanese Patent Application, First Publication, S63 (1988)-101004. This guide is also a standby type.

One of the problems in the slab rolling technology is lateral curving of the rolled slab as it exits the mill. FIG. 12 illustrates the degree of lateral curving, or snaking which occurs during rough rolling in a continuous hot rolling operation. FIG. 12(*a*) shows the extent of snaking measured at the center line of a rolled slab produced in a roughing mill (the fourth roughing stand R4), and shows that the head end HE and the tail end TE are bent towards the drive side. Similarly, FIG. 12(*b*) shows the extent of snaking of a rolled slab produced in a downstream roughing mill (the fifth roughing stand R5), and shows that the head end HE is bent towards the drive side, and the tail end TE is bent towards the work side, resulting in the formation of a S-shaped rolled slab. It is seen that such snaking occurs primarily in about a 3–5 m distance in the head and tail ends of a rolled slab, and such so-called "hooked nose" curving adversely affects the slab rollability, and contributes to the generation of wrinkling in the finish rolling process.

Lateral curving, or snaking, is caused by such reasons as off-centering of the rolled slab, widthwise temperature gradient in the rolled slab, uneven rolling pressures, other such factors. In the conventional side guide designs for the standby type of side guides, it is necessary to set the guides at a wide separation distance between the rolled slab and the guides so as to accommodate the incoming rolled slab smoothly, and therefore, it is not possible to completely prevent the formation of lateral curving. Even if centering of the rolled slab is performed hydraulically at the entrance to the edging mill, it is difficult to prevent the instances of lateral curving in the slab in the subsequent roughing mills.

In particular, the problem of lateral curving at the head end of the rolled slab has been attributed to the absence of the side guiding facility at the exit side of the horizontal mill, and the problem at the tail end of the rolled slab has been attributed to insufficient control on the guiding process after the tail end has left the edging mill.

SUMMARY OF THE INVENTION

The objective of the present invention is concerned with the method and apparatus for preventing horizontal curving, or snaking, generated during a rough rolling process of a rolled slab in a V-H tandem mill line comprising an edging mill and a horizontal mill disposed on the downstream side of the edging mill.

To accomplish the above objective, a guiding apparatus is presented for guiding a longitudinally extending rolled slab, defined by top and bottom surfaces and side surfaces, moving continuously from upstream to downstream through a roughing mill train which includes an upstream edging mill for widthwise control of the rolled slab, and a downstream horizontal mill for thickness control of the rolled slab, to prevent lateral positional shifting of the rolled slab during rough rolling, the guiding apparatus comprising:

(a) a first pair of side guides, consisting of a left guide component and a right guide component, disposed upstream of the edging mill for controlling lateral positional shifting of the rolled slab by moving laterally towards the side surfaces of the rolled slab;

(b) a second pair of side guides, consisting of a left guide component and a right guide component, disposed downstream of the horizontal mill for controlling lateral positional shifting of the rolled slab by moving laterally towards the side surfaces of the rolled slab; and (c) a third pair of side guides, consisting of a left guide component and a right guide component, disposed between the edging mill and the horizontal mill for controlling the lateral positional shifting of the rolled slab by moving towards the side surface of the rolled slab; wherein the left guide component and the right guide component of at least the first pair of side guides, of the three pairs of side guides, perform centering operations to continually align a widthwise center position of the rolled slab with an imaginary rolling line joining a widthwise center of the edging mill with a widthwise center of the horizontal mill by moving symmetrically and synchronously with each other towards and away from the operational rolling line.

According to a side guiding apparatus of the above structural configuration, the spacing of the side guides can be set sufficiently wide, for example 50–200 mm wider than the width of the rolled slab, so as not to hinder the entry of the incoming rolled slab. Such a side guide apparatus performs centering operations by decreasing the separation distance between the rolled slab and the first side guide, disposed on the entrance to the edging mill, to within 10–20 mm of the width of the rolled slab immediately upon the entry of the head end of the rolled slab, and by maintaining this narrow distance during the centering operation. Another variation is to perform centering while clamping the rolled slab between the guide components, and subsequently the guide spacing is opened by a limited amount such as 10–20 mm, and the rolled slab is guided through the edging mill while maintaining this narrow separation distance. By using such a procedure, the entire length of the rolled slab is guided through the edging mill under restraints.

Similarly, the second side guides disposed on the exit side of the horizontal mill closes the separation distance between the rolled slab and the guide component to within a limited range such as 5–10 mm, of a specified dimension as soon as the head end of the rolled slab enters the second side guides. Similarly, the third guides disposed between the edging mill and the horizontal mill closes the separation distance to a similar range as that in the second side guides, at least as soon as the tail end of the rolled slab passes through the edging mill. Accordingly, the lateral (widthwise) shifting of the rolled slab becomes restricted to within the narrow range of allowed separation distance, and even if lateral curving does occur, it is limited to the permitted range of separation distance. It follows that the finish rolling which follows is supplied with a curving-free rolling stock, enabling to eliminate semi-finished scrap products and leading to lowering of wrinkle formation to 1/10th of that generated in the conventional rolling.

The guiding method of the present invention is directed to preventing the lateral shifting of the rolled slab in a roughing facility having edging mills and the horizontal mills comprising: first side guides disposed upstream of the edging mills; second side guides disposed downstream of the horizontal mills; and third guides disposed between the edging mill and the horizontal mill. Lateral positional shifting of the rolled slab is prevented by: maintaining a wide separation distance until the head end of the rolled slab enters between the first side guides so as to allow the entry of the rolled slab without hindrance; and immediately upon the entry of the head end of the rolled slab in the region of the first side guides, separation distance is closed by moving both side guide components towards the longitudinal imaginary center line joining the center of the edging mill with the center of the horizontal mill, so as to narrow the spacing between the rolled slab and the side guides to within a limited range. The same purpose is served by another variation. In this variation, the rolled slab is centered in the edging mill while clamping the rolled slab between the first side guides, and after the rolled slab is centered and guided through the edging mill, the first side guides are quickly retracted so as to establish a narrow separation distance sufficient to allow the rolled slab to pass therebetween, and thenafter maintaining that narrow separation distance until the tail end of the rolled slab passes through the first side guides. According to this method presented, the first side guides serves to center the rolled slab as it is entering the edging mill, and the first side guides further serves to accurately guide the rolled slab in the edging mill throughout the entire length of rough rolling of the slab, thereby preventing positional shifting of the rolled slab in the edging mill.

Another method of guiding the rolled slab through the edging mill is to maintain a wide enough separation distance of the second side guides until the head end of the rolled slab enters between the second sides guides so as to provide a hindrance-free entry of the incoming rolled slab. Simultaneously with the entry of the head end of the rolled slab into the second side guides, the second side guides are moved towards the imaginary center line of the mill train so as to narrow the separation distance of the second side guides, and maintain a narrow separation sufficient to allow passing of the rolled slab therethrough until the tail end of the rolled slab passes through the second side guides. According to this method of guiding the rolled slab, localized curving is prevented by the second side guides by restricting the lateral positional shifting of the rolled slab.

Another method of guiding the rolled slab is to maintain a wide separation distance of the third side guides to allow a hindrance-free guided passing of the rolled slab until the tail end of the rolled slab passes through the edging mill. Simultaneously with the passing of the tail end of the rolled slab through the edging mill, the third side guides are moved towards the imaginary center line of the mill train so as to generate a narrow separation distance of the third side guides which is maintained until the tail end of the rolled slab passes through the third side guides. According to this method of guiding the rolled slab, even after the tail end of the rolled slab has passed through the edging mill, i.e. even after the loss of the restraining force of the edging mill on the rolled slab, the third side guides enable to prevent snaking of the extreme tail end of the rolled slab to cause localized curving.

Another embodiment of the guiding apparatus of the present invention is the provision of pinch rolls. A pair of pinch rolls, consisting of an upper component roll and a bottom component roll with the rolled slab therebetween, is disposed between the edging mill and the horizontal mill to prevent the lateral shifting of the rolled slab by pressing down at least one of the component rolls on the rolled slab with adjustable pressing force provided by a driving means. According to this method of guiding, the widthwise lateral shifting is prevented.

Yet another embodiment of the guiding method of the present invention is the provision of a control means for computing the exit timing of the tail end of the rolled slab through the edging mill, and controlling the operation of the pinch rolls so as to coincide the timing of increasing the pressing force of the pinch rolls on the rolled slab with the passing of the tail end of the rolled slab through the edging mill. According to this method of guiding the rolled slab through the roughing mill, it becomes possible to continue to provide lateral restraining force which had been provided by the edging mill during the final rolling stage by the pinch rolls, i.e. even after the tail end of the rolled slab has passed through the edging mill, thereby losing the restraining force by the edging mill. Therefore, it enables to prevent lateral curving caused by lateral positional shifting resulting in snaking of the tail end of the rolled slab.

PREFERRED EMBODIMENTS OF THE INVENTION

Figure 1:
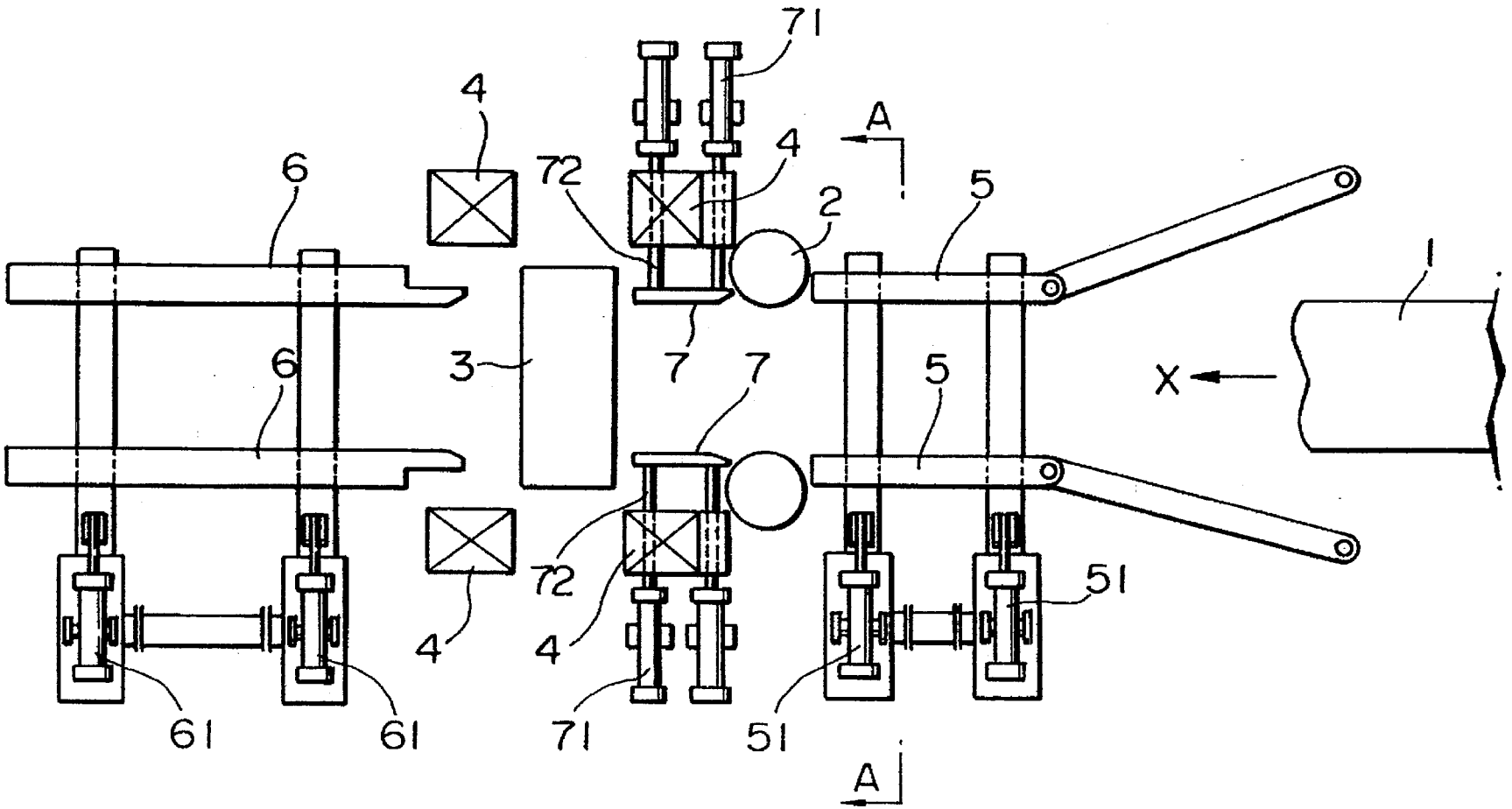
FIG. 1 is a first embodiment of a rolled slab guiding apparatus of the present invention.
Figure 2:
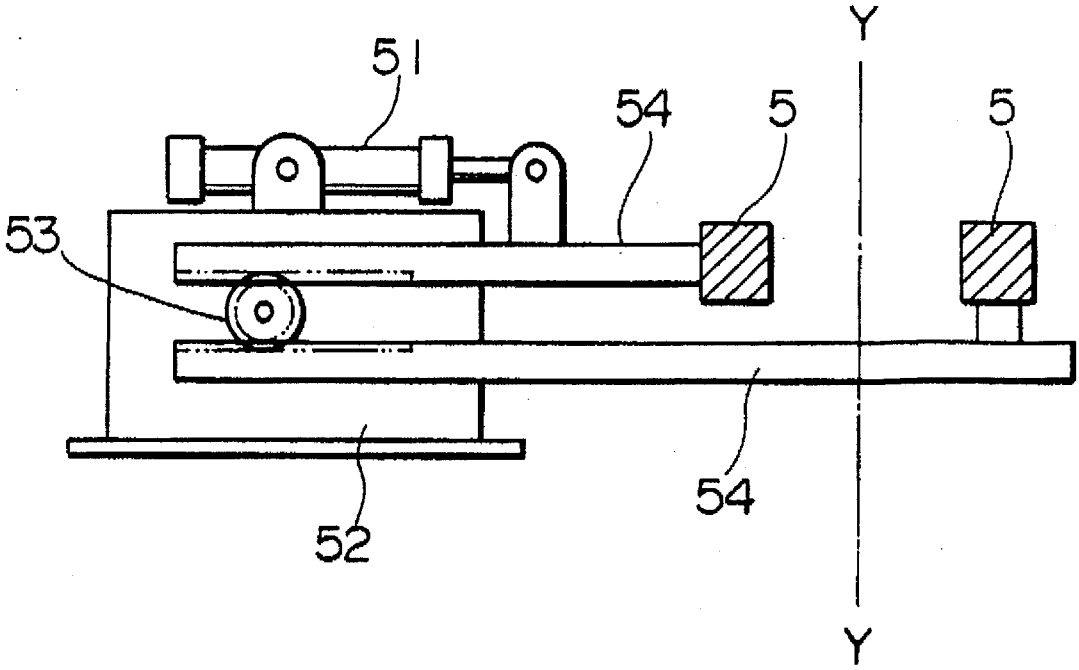
FIG. 2 is a cross sectional view seen through a section A—A shown in FIG. 1.

A first embodiment is presented in FIG. 1, in which the rolled slab 1 is shown to proceed from upstream to downstream in the direction marked with an arrow X, and is subjected to V-H tandem rolling by an edging mill 2 and a horizontal mill 3 disposed on the exit side thereof (downstream of the moving rolled slab 1). A pair of first side guides 5 are disposed on the entry side (upstream) of the edging mill 2, and perform the function of centering the rolled slab 1 in the edging mill 2, by opening and closing the pair of sides guides 5 synchronously and symmetrically with respect to the imaginary center line Y—Y of the mill train, shown in FIG. 2, which joins the center of the edging mill 2 with the center of the horizontal mill 3. The separation distance between the rolled slab and the guide component of the first side guides 5 is adjusted by means of the hydraulic cylinders 51 which operate the pinions 53 on the pinion stand 52 and the rack beam 54. A pair of second side guides 6 is disposed on the exit side of the horizontal mill 3, and the separation distance thereof is adjustable in this embodiment by means of the hydraulic cylinders 61 which performs centering through the rack and pinion arrangement as in the first side guides 5.

A pair of third side guides 7 is positioned between the edging mill 2 and the horizontal mill 3, and is disposed at the tip of the rod 72 passing through the housing posts 4 of the horizontal mill 3. The separation distance of the third side guides is also adjustable by means of the hydraulic cylinders 71.

In these cases, it is not necessary that the sides guides 5, 6 and 7 be operated hydraulically, but from the viewpoint of the responsiveness, a hydraulic system would be preferable. Further, the invention is not limited by the structural configuration utilized in this embodiment. It is sufficient that at least the first guide 5 should have the centering capability, and for the other two side guides 6 and 7, it is sufficient if their positional control can be achieved.

Figure 3:
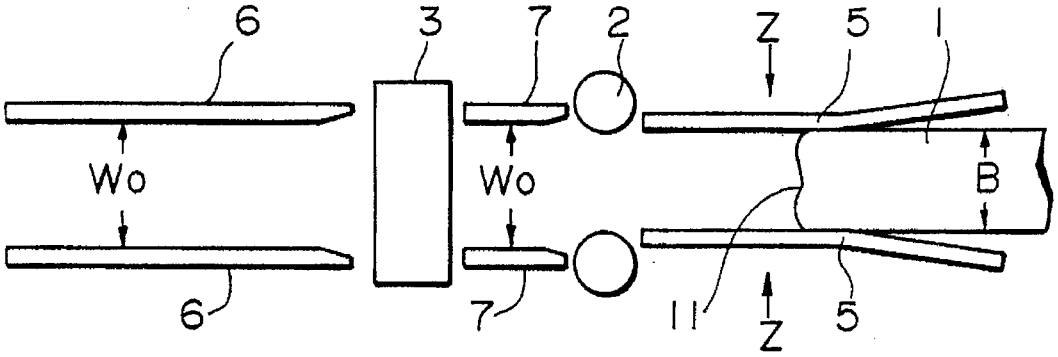
FIG. 3(*a*) to 3(*c*) are schematic drawings to explain the operation of the guiding apparatus of first embodiment of the present invention.
Figure 3:
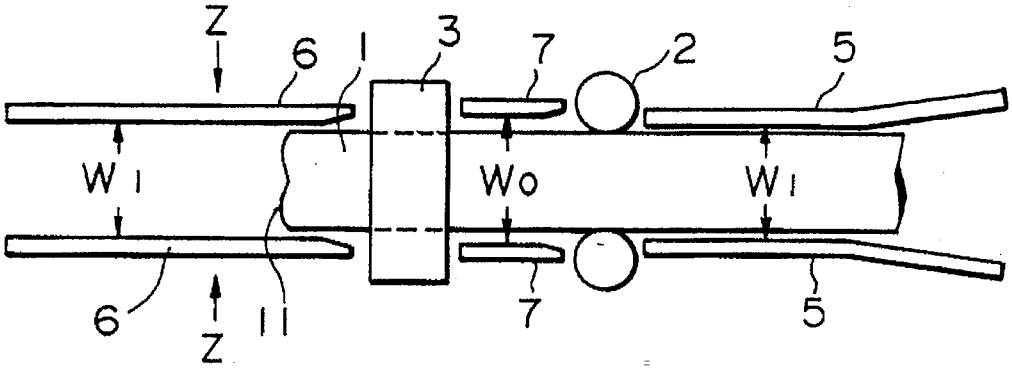
Figure 3:
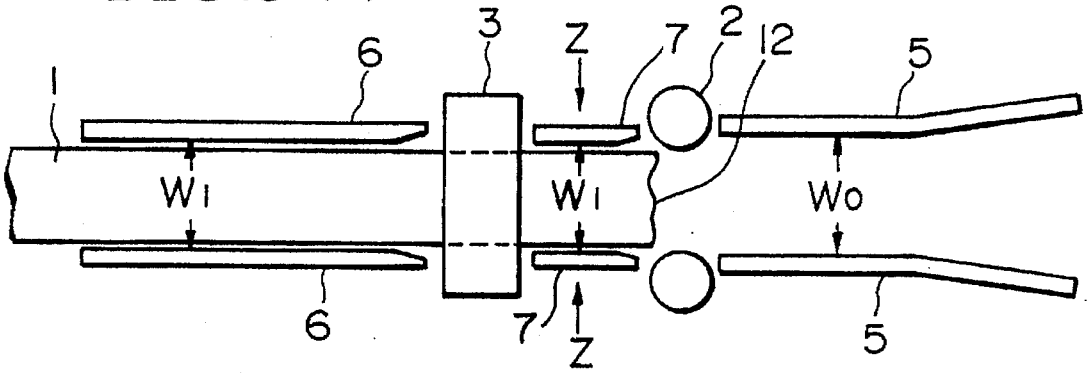

FIG. 3 shows a working sequence of operations of the sides guides 5, 6 and 7 as the rolled slab 1 enters the mill train from upstream to downstream. FIG. 3(*a*) shows an initial stage of performing centering, as the head end 11 of the rolled slab 1 enters the first side guides 5 disposed on the entry side of the edging mill 2. The separation distance of the first side guides 5 is closed in the direction Z to match the width B of the rolled slab 1 for clamping the rolled slab 1 therebetween. After the centering operation is completed, the separation distance of the first side guides 5 is increased to a narrow value W1 which is slightly wider, by about 10–20 mm, than the width of the rolled slab 1. This distance W1 is maintained until the rolled slab 1 passes through the first side guides 5. At this stage of the operation, the separation openings of the second and third sides guides 6 and 7 are set at W0 which is wider than the width B of the rolled slab 1 by about 50–200 mm.

Next, FIG. 3(*b*) shows the stage of rolling as the head end 11 of the rolled slab 1 enters between the second side guides 6 disposed on the exit side of the horizontal mill 3. As soon as the head end 11 of the rolled slab 1 begins entering the second side guides, the separation distance is closed to the dimension W1 by moving the guide arms in the Z direction. The V-H tandem rolling of the rolled slab 1, between the edging mill 2 and the horizontal mill 3, is performed while maintaining the separation distance at W1. In this case, the detection of the head end 11 of the rolled slab 1 entering the side guides 5 and 6 can be performed by HMD detector (hot steel detecting device), or it is also possible to monitor the changes in the bite signal of the rollers in the preceding mill.

In the next stage of operation, immediately prior to or after the tail end 12 of the rolled slab 1 is released from the bite of the rolls in the edging mill 2, the separation distance of the third side guides 7 is decreased to a distance W1. It is preferable to commence closing of the third side guides 7 beforehand by anticipating the moment of bite release from the edging mill 2. Commencing of the closure is controlled by signals from such detecting means as the tail end detector HMD disposed at the entry side of the edging mill 2.

The separation openings of the side guides 5, 6 and 7 are successively increased back to W0 as the tail end 12 of the rolled slab 1 passes through the respective side guides.

Figure 4:
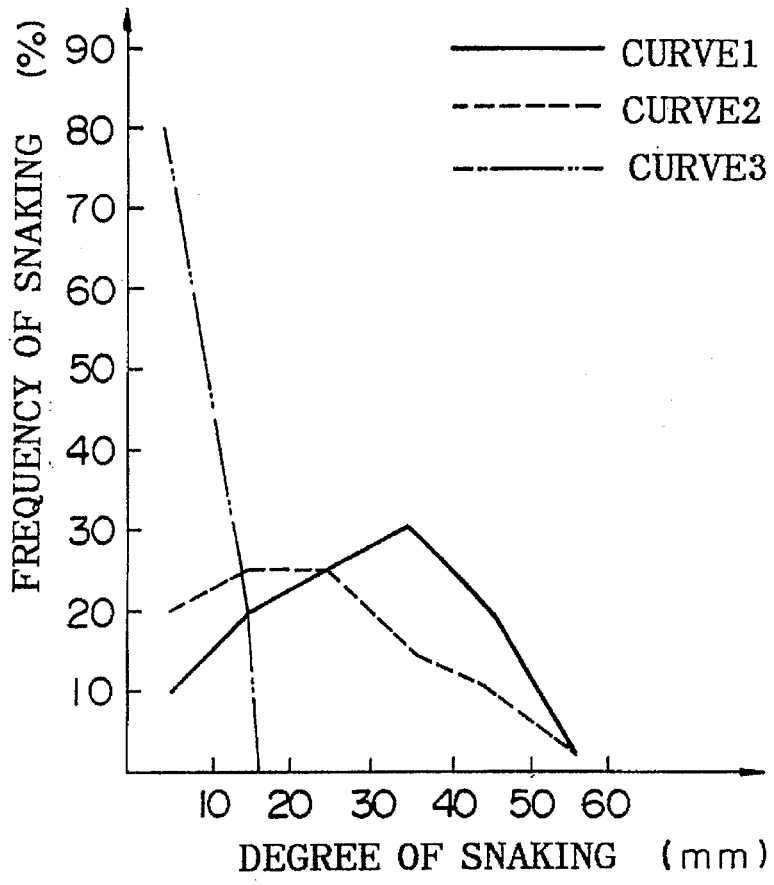
FIG. 4 is a graph comparing the frequency of occurrence of snaking of the rolled slab according to various guiding methods.

FIG. 4 is a comparative graph of the frequency of snaking, or lateral curving, produced by rolling the slab under different conditions of restraints. Curve 1 shows the results of a standby type arrangement produced by maintaining the separation distance of the first side guides at 50–100 mm wider than the width of the rolled slab. Curve 2 shows the results when the first side guides are used as centering device. Curve 3 shows the results when the second and third side guides were used as in the embodiment presented. In each case, approximately five hundred rolling trials were carried out using a roughing mill R3.

It can be seen that curving over a distance in excess of 50 mm is produced in the case of rolling presented by Curve 1. This is the condition generally existing in the conventional rough rolling.

In Curve 2, although the occurrence of lateral curving exceeding a 30 mm distance is decreased, high degree of curving has not been eliminated completely. It is suspected that this is because the roll friction cannot sufficiently overcome the adverse external influences such as the widthwise difference in the temperature.

In Curve 3, the results demonstrated that the side guides arrangement of the present invention was able to limit the curving distance to less than 20 mm, and the majority (80%) of the curving occurred within a short distance of 10 mm or less, thus producing a superior rolling stock for finishing mill train compared with the conventional roughing mill train.

The above description referred to a case of an independent V-H arrangement consisting of an edging mill and a horizontal mill disposed in a roughing mill train. In other cases in later stages of rough rolling, more than one V-H arrangement, such as both R4 and R5 mills in a tandem arrangement of V-H-V-H may be utilized. In such a case, the side guides of the present invention are arranged as shown in FIG. 5.

Figure 5:
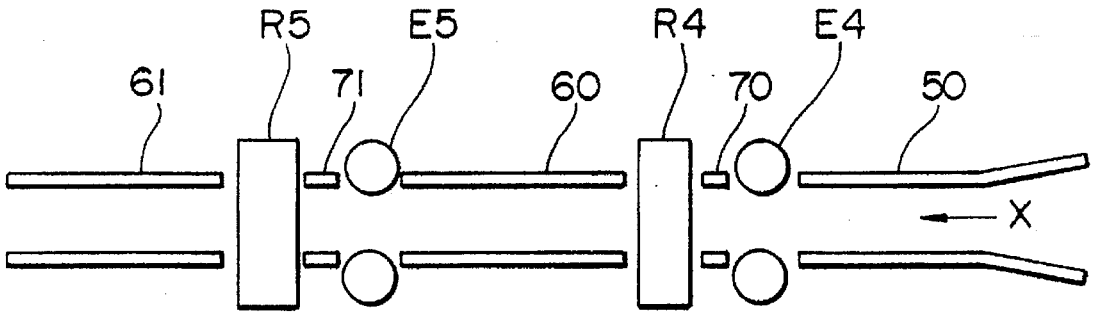
FIG. 5 is a plan view of an example of a guiding apparatus for use with a tandem mill train comprising a plurality of edging mills and horizontal mills.

In the case shown in FIG. 5, a pair of first side guides 50, which is capable of providing the same centering action as the first side guides 5, is disposed on the entry side of the farthermost upstream edging mill E4. A second side guides 60, similar to the second side guides 6, is disposed on the exit side of the horizontal mill R4; and a third side guides 70 similar to the third side guides 7 is disposed between the edging mill E4 and the horizontal mill R4; a fourth side guides 61 similar to the second side guides 60 is disposed on the exit side of the horizontal mill R5; a fifth side guides 71 similar to the third side guides 70 is disposed between the edging mill E5 and the horizontal mill R5. In this arrangement, the second and fourth side guides 60 and 61 are operated in the same way as the second side guides 6; and the third and fifth side guides 70 and 71 are operated in the same way as the third side guides 7.

Figure 6:
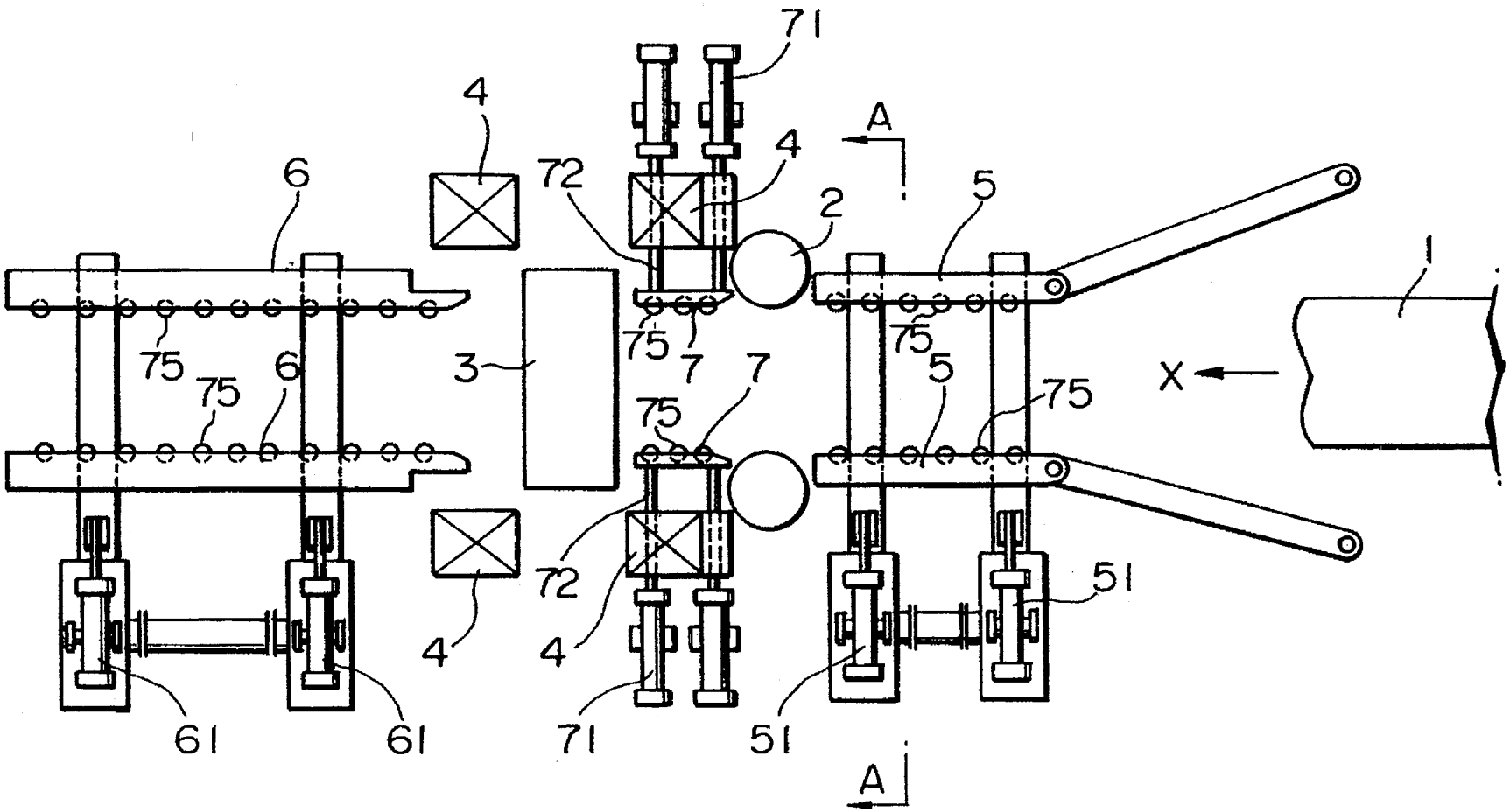
FIG. 6 is a plan view of an example of providing guide roller on side guides.

In another variation of the first embodiment shown in FIG. 1, it is preferable to dispose guide rollers 75 which rotate against the side surfaces of the rolled slab 1 on the side guides 5, 6 and 7, as shown in FIG. 6. In the embodiment presented earlier, the separation distance of the side guides 5, 6 and 7, while the rolled slab 1 is passing therethrough, was set at the width W1 which is 10–20 mm wider than the width of the rolled slab 1. By providing such guide rollers 75, it becomes possible to decrease the distance W1 of the separation distance even further.

Figure 7:
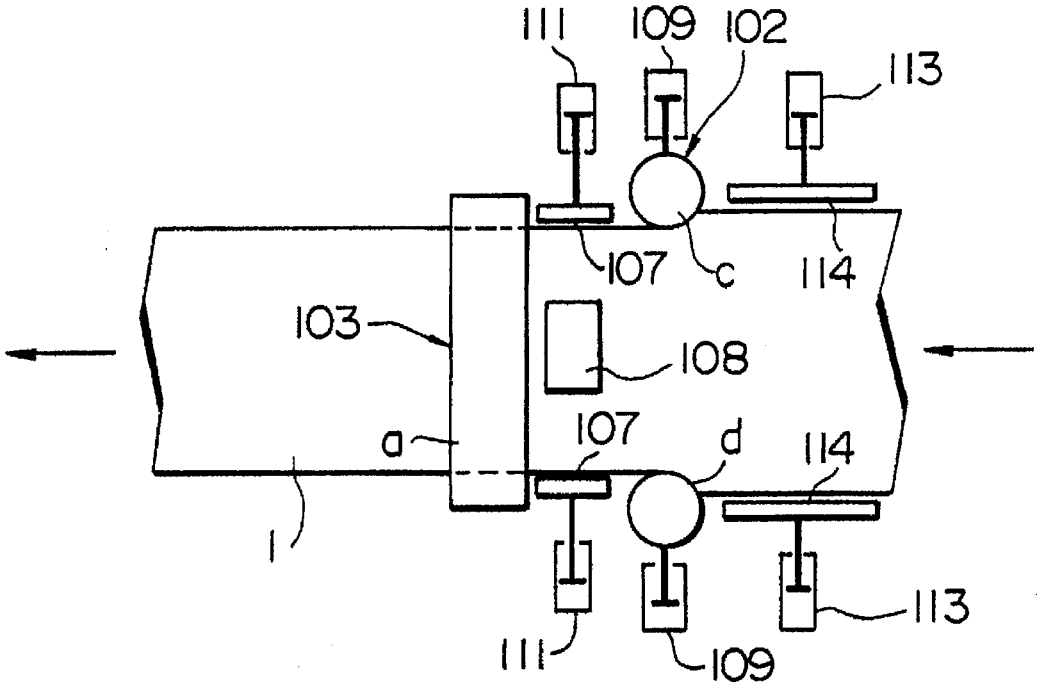
FIG. 7 is a plan view of a second embodiment of the guiding apparatus of the present invention.
Figure 8:
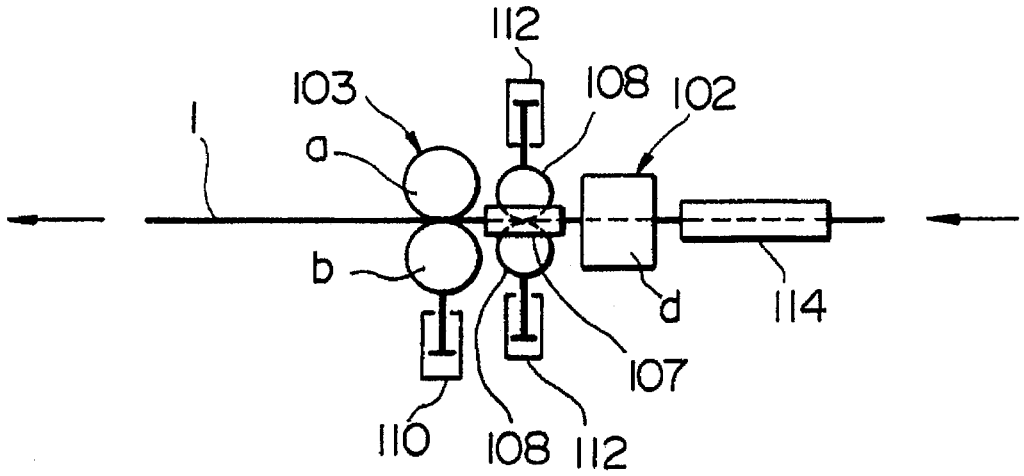
FIG. 8 is a side view of the apparatus shown in FIG. 7.

A second embodiment of the guiding apparatus of the present invention will be explained with reference to FIGS. 7 to 9. FIGS. 7 to 8 are schematic plan view and side view, respectively, of the configuration of the components of the guiding apparatus of a second embodiment. The roughing mill of the second embodiment, as in the mills of the first embodiment, comprises: a horizontal mill 103 provided with pair of work rolls a, b; and an edging mill 102, for performing widthwise rolling, disposed upstream of the horizontal mill 103 and is provided with a pair of vertical rolls c, d, as shown in FIG. 7. Between the edging mill 102 and the horizontal mill 103 is provided a pair of left and right side guides 107. Additionally, there is provided a pair of pinch rolls 108 comprising a top component roller and a bottom component roll. The reference numeral 109 refers to a pair of hydraulic pressure cylinders for the vertical rolls c, d of an edging mill 102; and 110 refers to a hydraulic pressure cylinder for the working roll b.

The side guides 107, similar to the previous third side guides 7, are disposed on opposing sides in the widthwise direction of the rolled slab 1 to prevent the lateral movement of the rolled slab 1. The hydraulic cylinder 111 provides means for adjusting the position and the spacing of the guides 107 in accordance with the width of the rolled slab 1. The pinch rolls 108 rotate freely with the rolled slab 1 by clamping the rolled slab 1 from top and bottom directions, and adjustable pinching force is provided by the hydraulic cylinders 112.

Further in this embodiment there is provided another side guides 114 similar to the first side guides in the first embodiment, disposed on the entry side of the edging mill 102, and are driven by the hydraulic cylinder 113, for centering and guiding the rolled slab 1 through the edging mill 102.

According to the roughing mill of the second embodiment, because the lateral movement of the rolled slab 1 is restricted by the side guides 107 and the pinch rolls 108 disposed between the edging mill 102 and the horizontal mill 103, it is not only capable of preventing the localized curving of the rolled slab 1 during the rolling operation of the midsection of the rolled slab 1, but it also assures the elimination of the localized curving in the tail end region caused by the lateral shifting (snaking) of the rolled slab 1 as the tail end 12 emerges out of the edging mill 102. In other words, when the rolled slab 1 passes through the edging mill 102 in the conventional roughing mill, the lateral restraining force is lost, and the rolled slab 1 becomes very susceptible to lateral shifting caused by the temperature difference between the left and right of the rolling material, or uneven roll gap spacing in the left and right sections of the horizontal mill 103. This is a direct reason for causing localized curving limited to the tail end region of the rolled slab 1. In contrast, as shown in FIG. 9, the roughing mill of the second embodiment restricts the lateral shifting of the rolled slab 1, even after the tail end 12 passed through the edging mill 102, due to the restricting actions of the side guides 107, and the pinch rolls 108 until it passes through the horizontal mill 103.

The pinching force of the pinching rolls 108 on the rolled slab 1 can be set appropriately in keeping with the lateral restraining force of the side guides 107, but in the last stage of rolling, it is preferable to increase the pinching force even more than during the earlier stages. During the normal rolling operation, that is, when the edging mill 102 is performing the widthwise rolling of the midsection of the rolled slab, there is the force of restraining the lateral shifting of the rolled slab 1 provided by the edging mill 102. Therefore the force of the pinching rolls 108 need not be set so high. However, when the tail end 12 of the rolled slab 1 has passed through the edging mill 102, the restraining force which had been exerted by the edging mill 102 becomes lost. At this stage of rolling, the pinching force of the pinching rolls 108 is increased to provide about the same level of restraining force existed during the normal rolling operation. When the pinching force is increased, the lateral restraining force caused by the frictional force $\mu P$ (where $\mu$ is the coefficient of friction between the rolled slab 1 and the pinch rolls 108, and P is the pinching force) is increased. The force restricting the lateral shifting of the rolled slab 1 is thus increased, and the tendency caused by snaking of the rolled slab 1 to cause the rolled slab 1 to ride over the side guides 107 is also prevented.

Figure 9:
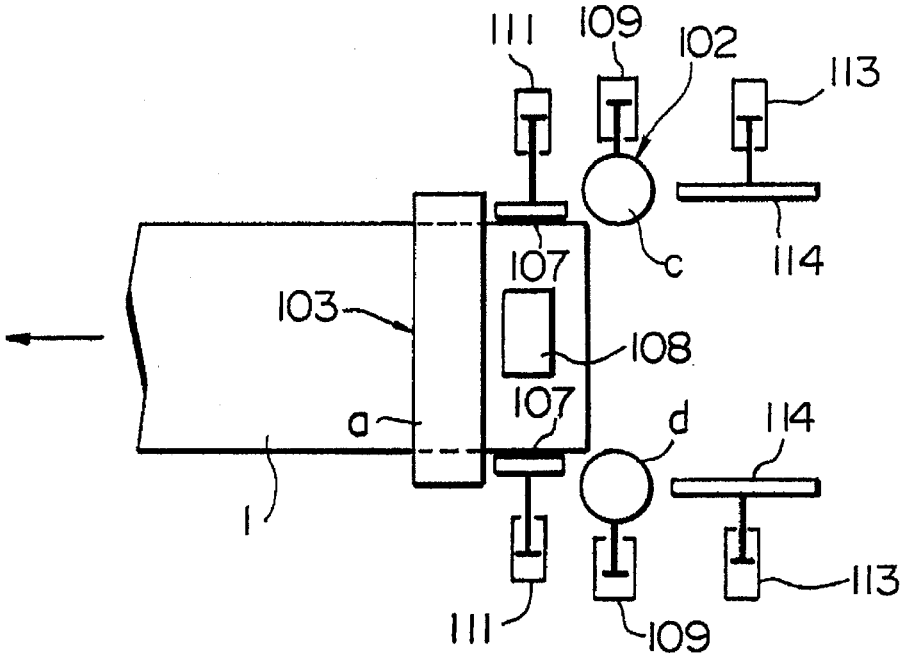
FIG. 9 is a plan view showing the final stages of rolling in a roughing mill train which are suitable for application of the guiding apparatus of the present invention.
Figure 10:
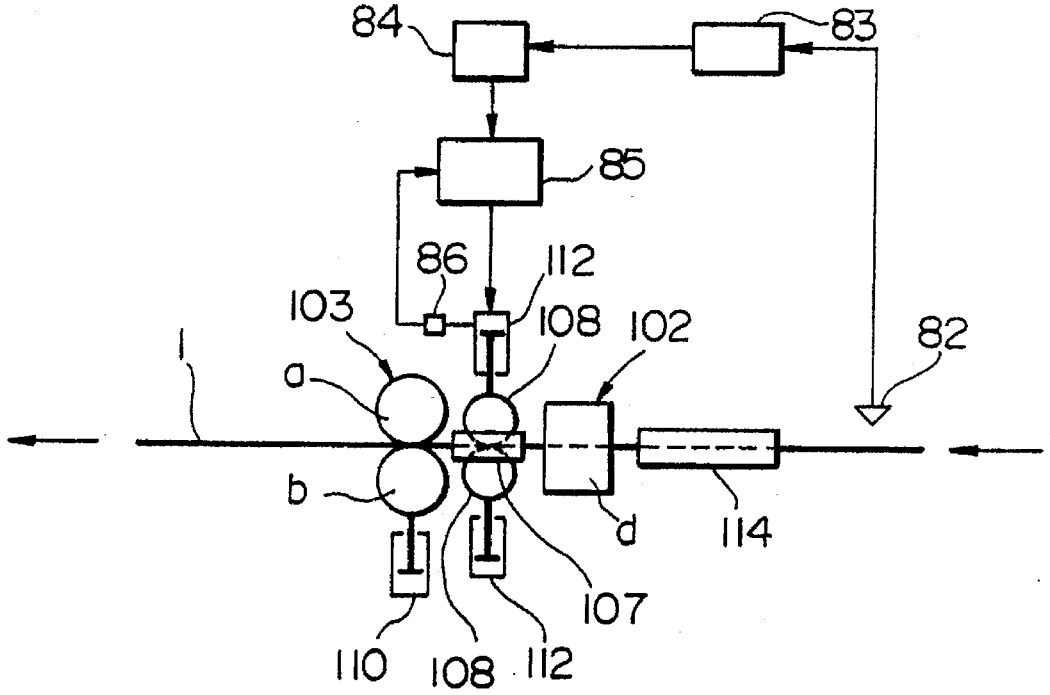
FIG. 10 is a side view of a third embodiment of the guiding apparatus of the present invention.

FIG. 10 is a schematic drawing for a third embodiment, showing the addition of a control system for the pinch rolls 108 of the guiding apparatus shown in FIG. 9. The reference numeral 82 refers to a slab detector for detecting that the tail end 12 of the rolled slab 1 has passed through the detector point; 83 is a tracking circuit which calculates the exit timing for the tail end 12 of the rolled slab 1 to pass through the edging mill 102 on the basis of the signal received from the detector 83, and forwards the exit timing signal to the pressure setting device 84. The pressure setting device 84 receives the exit timing signal, and changes the setting pressure accordingly. The controller 85 controls the pressure of the hydraulic cylinder 112, and compares the pressure setting signal from the pressure setting device 84 with the pressure sensor 86 of the hydraulic cylinder 112 with a computer (not shown), and adjusts the adjusting valve (not shown) to maintain the force for pressing the pinch roll 108 by means of the hydraulic cylinder 112 at a value indicated by the pressure setting device 84.

The operation of the apparatus having the control configuration described above will be explained in the following with reference to FIG. 10. When the detector 82 detects the passing of the rolled slab 1 through the edging mill 102, an exit timing signal is forwarded to the tracking circuit 83. The tracking circuit 83 calculates the running speed of the rolled slab 1, and on the basis of the distance between the detector 82 and the edging mill 102, calculates the time required for the tail end 12 of the rolled slab 1 to passes through the edging mill 102, and forwards the exit timing signal to the pressure setting device 84. The pressure setting device 84, upon receiving the exit timing signal, sets a predetermined pressure value higher than the existing value in the pressure setting device 84, and enters this value in the control device 85. The control device 85 controls the adjusting valve on the basis of a set value to control either one or both of fluid pressure and/or flow value to operate the hydraulic cylinder 112. Accordingly, the force of the hydraulic cylinder 112 on the pinch rolls to press down on the rolled slab 1 is altered. The pressure of the hydraulic cylinder 112 is detected by the pressure detector 86, and compared with the set value from the pressure controller 85, and the adjusting valve is operated to equalize the existing pressure to be the same as the predetermined pressure value so as to provide a new and higher pressure setting than the normal rolling value so as to press the pinch rolls 108 against the rolled slab 1. Because the pressing force is thus increased, snaking of the rolled slab 1 after the tail end 12 has passed through the edging mill 102 is prevented, thereby preventing the localized curving of the rolled slab 1.

Figure 11:
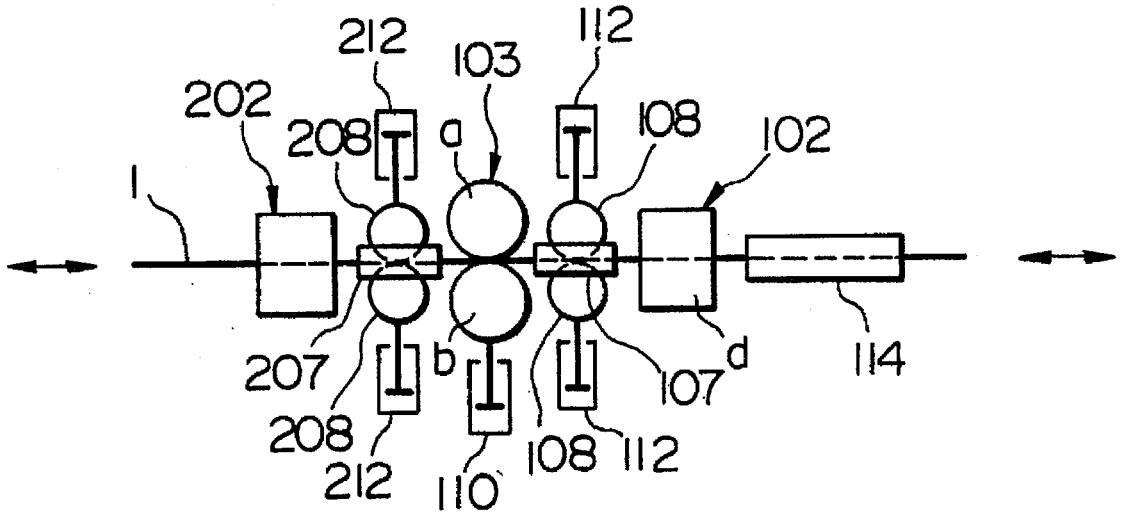
FIG. 11 a side view of a guiding apparatus of the present invention applied to roughing mill with reverse rolling capability.
Figure 12:
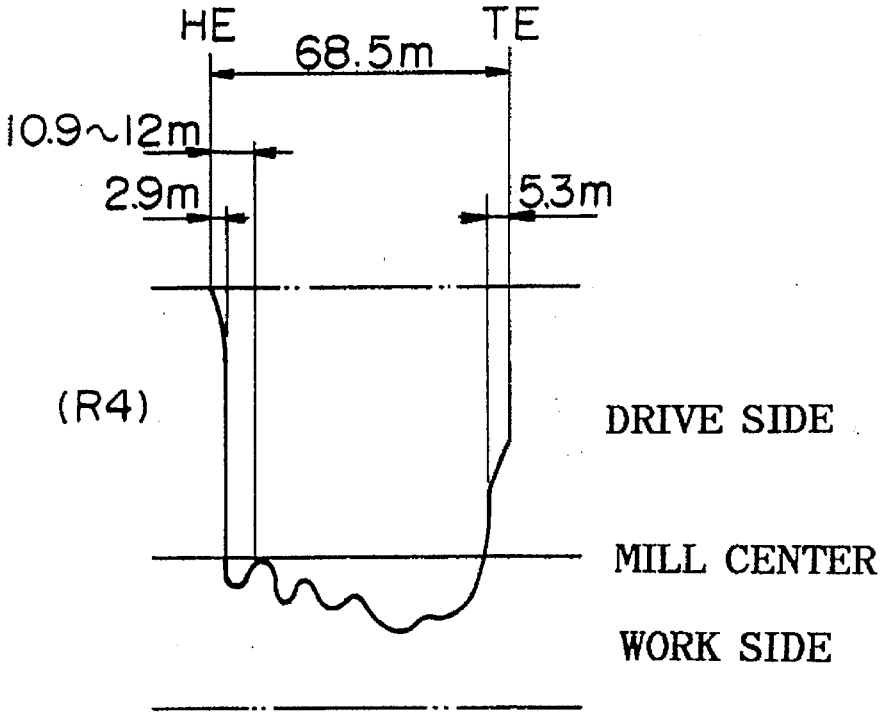
FIG. 12(*a*) and 12(*b*) show graphs showing the degree of lateral curving in the rolled slab, shortened and seen in a planar direction, generated in different mills in a continuous roughing mill.
Figure 12:
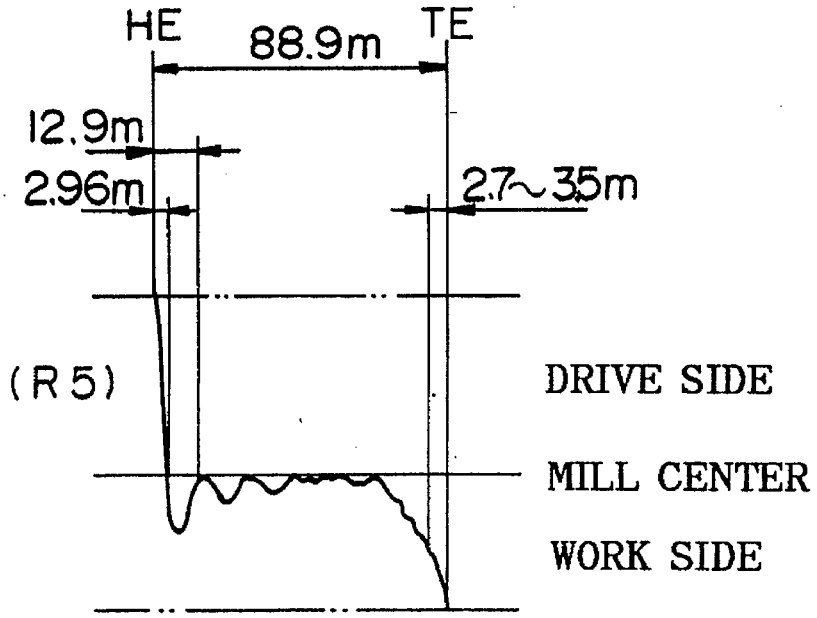

To apply the guiding apparatus of the present invention to a mill train for performing reverse rolling, it is preferable to arrange the edging mill, side guides, and pinch rolls symmetrically with respect to the horizontal mills, as shown in FIG. 11. In other words, add the required components, listed below, to the configuration shown in FIG. 8, in the downstream side of the horizontal mill 103. An edging mill 202 similar to the edging mill 102 is disposed downstream to the horizontal mill 103; a pair of pinch rolls 208, the pinching force of which is adjustable by means of the hydraulic cylinder 212, between the edging mill 202 and the horizontal mill 103 as described in the previous embodiment; and a pair of side guides 207 similar to the side guides 107. When performing reverse rolling in such a rolling facility, the pinch rolls 208 and the side guides 207 are both used to prevent the lateral shift of the rolled slab 1. It should be noted that the side guides 207 may be omitted in this embodiment.

In the foregoing embodiments, the horizontal mills were of a 2-high type consisting of a pair of work rolls, but a 4-high types having an extra pair of supporting rolls on both sides are also acceptable. It is also permissible to design a rolling line so that both edging mill and horizontal mill are housed in one housing frame. Regarding the pinch rolls in the foregoing embodiments, they were designed to operate hydraulically from both top and bottom directions, but they could be designed such that the bottom pinch roll is fixed and the top pinch roll alone is a hydraulic operation. Furthermore, the horizontal mills and edging mills in the embodiments were of the fluid driven types, but it is clear that electrical drives such as electrical motors combined with screw arrangements are also applicable to the various variations of the embodiments. It can be seen that many other variations in the designs are possible without deviating from the basic designs outlined in the present invention, and that the present invention is limited only by the claims which follow.

What is claimed is:

1. A guiding apparatus for guiding a longitudinally extending rolled slab, defined by top and bottom surfaces and side surfaces, moving continuously from upstream to downstream through a roughing mill train which includes an upstream edging mill for widthwise control of said rolled slab, and a downstream horizontal mill for thickness control of said rolled slab, to prevent lateral positional shifting of said rolled slab during rolling, said guiding apparatus comprising:

(a) a first pair of side guides, consisting of a left guide component and a right guide component, disposed upstream of said edging mill for controlling lateral positional shifting of said rolled slab by moving laterally towards the side surfaces of said rolled slab;

(b) a second pair of side guides, consisting of a left guide component and a right guide component, disposed downstream of said horizontal mill for controlling lateral positional shifting of said rolled slab by moving laterally towards said side surfaces of said rolled slab; and (c) a third pair of side guides, consisting of a left guide component and a right guide component, disposed between said edging mill and said horizontal mill for controlling the lateral positional shifting of said rolled slab by moving towards said side surface of said rolled slab; wherein said left guide component and said right guide component of at least said first pair of side guides, of the three pairs of side guides, are provided for performing centering operations to continually align a widthwise center position of said rolled slab with an imaginary rolling line joining a widthwise center of said horizontal mill by moving symmetrically and synchronously with each other towards and away from said imaginary rolling line, and said first pair of side guides are provided for clamping and centering said rolled slab between said left guide component and said right guide component of said first side guides when a head end of said rolled slab is positioned upstream of said edging mill;

and wherein said left guide component and said right guide component of said third pair of side guides define surfaces that are substantially parallel to one another, and remain parallel to one another as they move towards said side surfaces of said rolled slab.

2. A guiding apparatus as claimed in claim 1, wherein another roughing mill train, including a second edging mill and a second horizontal mill, is disposed downstream of said roughing mill train, and wherein a fourth pair of side guides constructed similarly to said second pair of side guides is disposed downstream of said second horizontal mill, and a fifth pair of side guides constructed similarly to said third pair of side guides is disposed between said second edging mill and said second horizontal mill.

3. A guiding apparatus as claimed in claim 1, wherein said side guides are provided with guide rollers which rotate in contact with said side surfaces of said rolled slab.

4. A method for guiding to prevent lateral positional shifting of a longitudinally extending rolled slab, defined by top and bottom surfaces and side surfaces, moving continuously from upstream to downstream through a roughing mill train including an edging mill for widthwise control of said rolled slab, and a horizontal mill for thickness control of said rolled slab, wherein guiding is performed by guiding means comprising:

(a) a first pair of side guides, consisting of a left guide component and a right guide component, disposed upstream of said edging mill for controlling lateral positional shifting of said rolled slab by moving said left guide component and said right guide component, symmetrically and synchronously with each other, towards and away from an imaginary rolling line joining a widthwise center of said edging mill with a widthwise center of said horizontal mill;

(b) a second pair of side guides, consisting of a left guide component and a right guide component, disposed downstream of said horizontal mill for controlling lateral positional shifting of said rolled slab by moving laterally towards said side surfaces of said rolled slab; and (c) a third pair of side guides, consisting of a left guide component and a right guide component, said left guide component and said right guide component defining surfaces that are substantially parallel to one another, disposed between said edging mill and said horizontal mill for controlling the lateral positional shifting of said rolled slab by moving towards said side surface of said rolled slab;

said method comprising the steps of:

(d) maintaining a wide separation distance of said first side guides so as to provide a hindrance-free entry of said rolled slab therebetween until said rolled slab enters between said first side guides;

(e) clamping said rolled slab between said left guide component and said right guide component of said first pair of side guides, and centering said rolled slab between said first pair of side guides; and (f) moving said left guide component and said right guide component of said third pair of side guides toward said rolled slab such that the respective surfaces of said left guide component and said right guide component remain substantially parallel.

5. A method for guiding as claimed in claim 4, said method further comprising the steps of:

(g) rapidly retracting said left guide component and said right guide component so as to generate a narrow separation distance of said first side guides to allow guided passing of said rolled slab through said first side guides, and (h) maintaining said narrow separation distance to provide guided passing until a tail end of said rolled slab passes through said first side guides.

6. A method for guiding as claimed in claim 5, wherein said third side guides operate by:

(a) maintaining a wide separation distance of said third side guides to provide hindrance-free passing of said rolled slab until a tail end of said rolled slab passes through said edging mill; and (b) moving said left guide component and said right guide component of said third side guides towards said imaginary center line so as to provide a narrow separation distance to provide guided passing of said rolled slab immediately prior to or immediately after said rolled slab passes said edging mill; and (c) maintaining said narrow separation distance to provide guided passing of said rolled slab until said tail end of said rolled slab passes through said third side guides.

7. A method for guiding as claimed in claim 6, wherein said second side guides operate by:

(a) maintaining a wide separation distance of said second side guides to provide a hindrance-free entry of said rolled slab until a head end of said rolled slab enters between said second side guides;

(b) moving said left guide component and said right guide component of said second side guides towards said imaginary center line so as to provide a narrow separation distance to provide guided passing of said rolled slab as soon as said rolled slab enters between said second side guides.

8. A method for guiding to prevent lateral positional shifting of a longitudinally extending rolled slab, defined by top and bottom surfaces and side surfaces, moving continuously from upstream to downstream through a roughing mill train including an edging mill for widthwise control of said rolled slab, and a horizontal mill for thickness control of said rolled slab, wherein guiding is performed by guiding means comprising:

(a) a first pair of side guides, consisting of a left guide component and a right guide component, disposed upstream of said edging mill for controlling lateral positional shifting of said rolled slab by moving said left guide component and said right guide component, symmetrically and synchronously with each other, towards and away from an imaginary rolling line joining a widthwise center of said edging mill with a widthwise center of said horizontal mill;

(b) a second pair of side guides, consisting of a left guide component and a right guide component, disposed downstream of said horizontal mill for controlling lateral positional shifting of said rolled slab by moving laterally towards said side surfaces of said rolled slab; and (c) a third pair of side guides, consisting of a left guide component and a right guide component, said left guide component and said right guide component defining surfaces that are substantially parallel to one another, disposed between said edging mill and said horizontal mill for controlling the lateral positional shifting of said rolled slab by moving towards said side surface of said rolled slab;

said method comprising the steps of:

(d) clamping said rolled slab between said left guide component and said right side component of said first pair of side guides, and centering said rolled slab between said first pair of side guides;

(e) moving said left guide component and said right guide component of said third pair of side guides toward said rolled slab such that the surfaces of said left guide component and said right guide component remain substantially parallel;

(f) providing a wide separation distance to said second side guides so as to allow a hindrance-free entry of said rolled slab therebetween;

(g) moving said left guide component and said right guide component of said second side guides towards said imaginary center line so as to provide a narrow separation distance to provide guided passing as soon as said rolled slab enters the second side guides; and (h) maintaining said narrow separation distance to provide guided passing until said rolled slab passes through said second side guides.

9. A method for guiding to prevent lateral positional shifting of a longitudinally extending rolled slab, defined by top and bottom surfaces and side surfaces, moving continuously from upstream to downstream through a roughing mill train including an edging mill for widthwise control of said rolled slab, and a horizontal mill for thickness control of said rolled slab, wherein guiding is performed by guiding means comprising:

(a) a first pair of said guides, consisting of a left guide component and a right guide component, disposed upstream of said edging mill for controlling lateral positional shifting of said rolled slab by moving said left guide component and said right guide component, symmetrically and synchronously with each other, towards and away from an imaginary rolling line joining a widthwise center of said edging mill with a widthwise center of said horizontal mill;

(b) a second pair of side guides, consisting of a left guide component and a right guide component, said left guide component and said right guide component defining surfaces that are substantially parallel, disposed between said edging mill and said horizontal mill for controlling lateral positional shifting of said rolled slab by moving laterally towards said side surfaces of said rolled slab; and (c) a third pair of side guides, consisting of a left guide component and a right guide component, said left guide component and said right guide component defining surfaces that are substantially parallel, disposed between said edging mill and said horizontal mill for controlling the lateral positional shifting of said rolled slab by moving towards said side surface of said rolled slab; said method comprising the steps of:

(d) clamping said rolled slab between said left guide component and said right guide component of said first pair of side guides, and centering said rolled slab between said first pair of side guides;

(e) providing a wide separation distance to said third side guides so as to allow a hindrance-free entry of said rolled slab therebetween until a head end of said rolled slab passes through said edging mill;

(f) moving said left guide component and said right guide component of said third side guides towards said imaginary center line, such that the surfaces of said left guide component and said right guide component remain substantially parallel, so as to provide a narrow separation distance to provide guided passing of said rolled slab before or as soon as said tail end of said rolled slab passes through and enters the edging mill; and (g) maintaining said narrow separation distance to provide guided passing of said rolled slab until said rolled slab passes through said third side guides.

10. A guiding apparatus for guiding a longitudinally extending rolled slab, defined by top and bottom surfaces and side surfaces, moving continuously from upstream to downstream through a roughing mill train which includes an edging mill for widthwise control of said rolled slab, and a horizontal mill for thickness control of said rolled slab, to prevent lateral positional shifting of said rolled slab during rough rolling, said guiding apparatus comprising:

(a) a first pair of side guides, consisting of a left guide component and a right guide component, disposed upstream of said edging mill, for clamping and centering said rolled slab when a head end of said rolled slab is positioned upstream of said edging mill;

(b) a pair of pinch rolls, having said rolled slab positioned between an upper pinch roll and a lower pinch roll, disposed between said edging mill and said horizontal mill, to roll compress said rolled slab so as to prevent lateral positional shifting of said rolled slab during rough rolling while allowing passing of said rolled slab therethrough; and (c) a control device for providing adjustable roll compressing force to at least one of said upper pinch roll and said lower pinch roll.

11. A guiding apparatus as claimed in claim 10, said apparatus further comprising a pair of pinch roll side guides, having said rolled slab positioned between a left guide component and a right guide component, disposed between said edging mill and said horizontal mill for preventing lateral positional shifting of said rolled slab during rough rolling.

12. A guiding apparatus as claimed in claim 11, wherein said side guides are provided with guide rollers which rotate in contact with said side surfaces of said rolled slab.

13. A guiding apparatus as claimed in claim 11, said apparatus further comprising:

(a) detecting means disposed upstream of said edging mill, for detecting passing-by of a tail end of said rolled slab and for generating a detected signal when said tail end passes by said detecting means;

(b) computing means for computing the exit timing of said tail end from said edging mill, based on said detected signal, and for generating an exit signal; and, (c) setting means for altering and setting said adjustable roll compressing force based on said exit signal.

14. A guiding apparatus as claimed in claim 11, wherein said apparatus further comprises a second edging mill, similar to said edging mill, disposed downstream of said horizontal mill; and a second pair of side guides, similar to said pair of side guides, and a pair of pinch rolls disposed between said second edging mill and horizontal mill so as to enable performing of reverse rolling of said rolled slab between said roughing mill train and said second edging mill.

15. A method for preventing lateral positional shifting of a rolled slab moving continuously from upstream to downstream through a roughing mill train comprising: an edging mill for widthwise control of said rolled slab; a horizontal mill disposed downstream of said edging mill for thickness control of said rolled slab; a pair of side guides consisting of a left guide component and a right guide component upstream of said edging mill; and a pair of pinch rolls disposed between said edging mill and said horizontal mill for roll compressing said rolled slab between an upper pinch roll and a lower pinch roll;

said method comprising the steps of clamping and centering said rolled slab between said left guide component and said right guide component when a head end of said rolled slab is positioned upstream of said edging mill; computing an exit timing of said rolled slab through said edging mill; and increasing the force of roll compressing by said pair of pinch rolls on the basis of said exit timing.

* * * * *